US006881044B1

(12) United States Patent
Thomas, Jr. et al.

(10) Patent No.: US 6,881,044 B1
(45) Date of Patent: Apr. 19, 2005

(54) ROTARY VANE COMPRESSOR WITH INTERCHANGEABLE END PLATES

(75) Inventors: Delbert L. Thomas, Jr., Watervliet, MI (US); William S. Otte, Stevensville, MI (US); Lorraine J. Westlake, Eau Claire, MI (US)

(73) Assignee: Gast Manufacturing Corporation, Benton Harbor, MI (US)

( * ) Notice: Subject to any disclaimer, the term of this patent is extended or adjusted under 35 U.S.C. 154(b) by 0 days.

(21) Appl. No.: 10/699,428

(22) Filed: Oct. 31, 2003

(51) Int. Cl.[7] ..... F01C 13/00
(52) U.S. Cl. ..... 418/39; 418/259
(58) Field of Search ..... 418/39, 259

(56) References Cited

U.S. PATENT DOCUMENTS

| | | | | | |
|---|---|---|---|---|---|
| 3,253,546 | A | * | 5/1966 | Cook | 418/39 |
| 3,525,578 | A | | 8/1970 | Le Blanc, Jr. | 418/13 |
| 3,649,141 | A | | 3/1972 | Belcher | 418/186 |
| 4,011,033 | A | | 3/1977 | Christy | 418/253 |
| 4,244,680 | A | | 1/1981 | Ishizuka et al. | 418/97 |
| 4,362,480 | A | | 12/1982 | Suzuki et al. | 418/152 |
| 4,484,863 | A | | 11/1984 | Pagel | 417/204 |
| 4,486,158 | A | | 12/1984 | Maruyama et al. | 418/39 |
| 4,627,802 | A | | 12/1986 | Draaisma et al. | 418/185 |
| 4,838,772 | A | | 6/1989 | LeBlanc | 418/13 |
| 4,877,384 | A | | 10/1989 | Chu | 418/184 |
| 5,169,299 | A | | 12/1992 | Gannaway | 418/94 |
| 5,611,485 | A | | 3/1997 | Davis | 239/8 |
| 5,868,175 | A | * | 2/1999 | Duff et al. | 418/259 |
| 5,876,359 | A | | 3/1999 | Bock et al. | 601/150 |

OTHER PUBLICATIONS

Gast Catalog, Copyright 1998, pp. 12–15 regarding the Gast 23 Series Compressors.

Operation and Maintanace Manual for RV03–RV05 Series Oil as Compressors, Copyright 2001, Part No. 70–298 PL (REV B) 8 pages.

* cited by examiner

*Primary Examiner*—Theresa Trieu
(74) *Attorney, Agent, or Firm*—Barnes & Thornburg LLP

(57) ABSTRACT

An improved rotary vane compressor includes an elongated housing having a main part and two ends. An inlet/outlet end plate member positioned at one end of the housing has an inlet port and an outlet port. The end plate member is one of a first type having ports constructed for tube-type connections and to receive a tube type conduit or a second type having an ports constructed for threaded type connections. Intermediate adapter member positioned between the housing and the end plate member, is secured to the housing and adapted to receive an end plate member of either the first type or the second type.

6 Claims, 3 Drawing Sheets

ROTARY VANE COMPRESSOR WITH INTERCHANGEABLE END PLATES

FIELD OF THE INVENTION

This invention relates to rotary vane compressors and more particularly to compressors with different end plates having different inlet and outlet port constructions.

BACKGROUND OF THE INVENTION

Compressors are used in sewage aeration applications to deliver compressed air to sewage for treatment. The compressors run continuously (e.g. 24 hours a day, seven days a week) and thus may be need to be replaced at frequent intervals.

Two types of compressors are commonly used. One is a rotary vane compressor and the other type is a double diaphragm linear compressor. Both types are known in the art. Each type of compressor includes an end construction with an inlet and an outlet port or connection unique to that type of compressor. For example, double diaphragm linear compressors include simple tube connections which may be hollow sleeves having cylindrical shapes with perhaps ring-like retaining barbs for receiving tubes. Rotary vane compressors use threaded connections of the plumbing or National Pipe Thread type for receiving threaded members, such as pipes.

In the aeration application it is sometimes desirable to substitute a rotary vane compressor with threaded connections for a double diaphragm linear compressor which uses tube-type connections. But the substitution is impeded by the mismatch between the tube-type connection and the threaded connection. Thus the ability to retrofit compressors in the field is impeded.

Rotary vane compressors typically include a rotor with vanes which rotates within a cylindrical housing. By that rotation air is drawn into the compressor, compressed and then exits as compressed air. The entry and exit is via the ports/connections discussed above.

Such rotary vane compressors are available from Gast Manufacturing, Inc., 2550 Meadowbrook Road, Benton Harbor, Mich. 49023. In particular, see the Gast "23 Series" compressors shown in the Gast Catalog, Copyright 1998, at pp 12–15. These compressors include an end plate forming a "muffler box" which is constructed so as to have both (1) threaded inlet and outlet ports and (2) sound mufflers. The end plate has some thickness or depth and the ports are located at the top thereof.

SUMMARY OF THE INVENTION

There is provided by this invention a system for field retrofitting a rotary vane compressor that is useful with end plate members that have ports of either the tube-type or the threaded-type.

The system includes two different end plates from which the plate appropriate to the application can be selected. One plate is a "muffler box" which includes the threaded inlet and outlet connections and sound mufflers. The other plate has tube connections. Also provided as part of the system is an intermediate adapter member (sometimes referred to as a front plate) to which a selected end plate is secured. The intermediate adapter plate is secured to the compressor housing and is positioned between the compressor housing and the end plate for communication of gas to and from the selected end plate. More specifically, the intermediate adapter member is a flat recessed plate-like member having a peripheral collar and a divider rib that divides the adapter member into an inlet section and an outlet section. The end plate and intermediate adapter member are arranged such that the inlet and outlet sections and the end plate inlet and outlet ports respectively are in communication.

The foregoing and other objects of this invention will be apparent from the following description and appended claims.

DESCRIPTION OF THE PREFERRED EMBODIMENT

Figure 1:
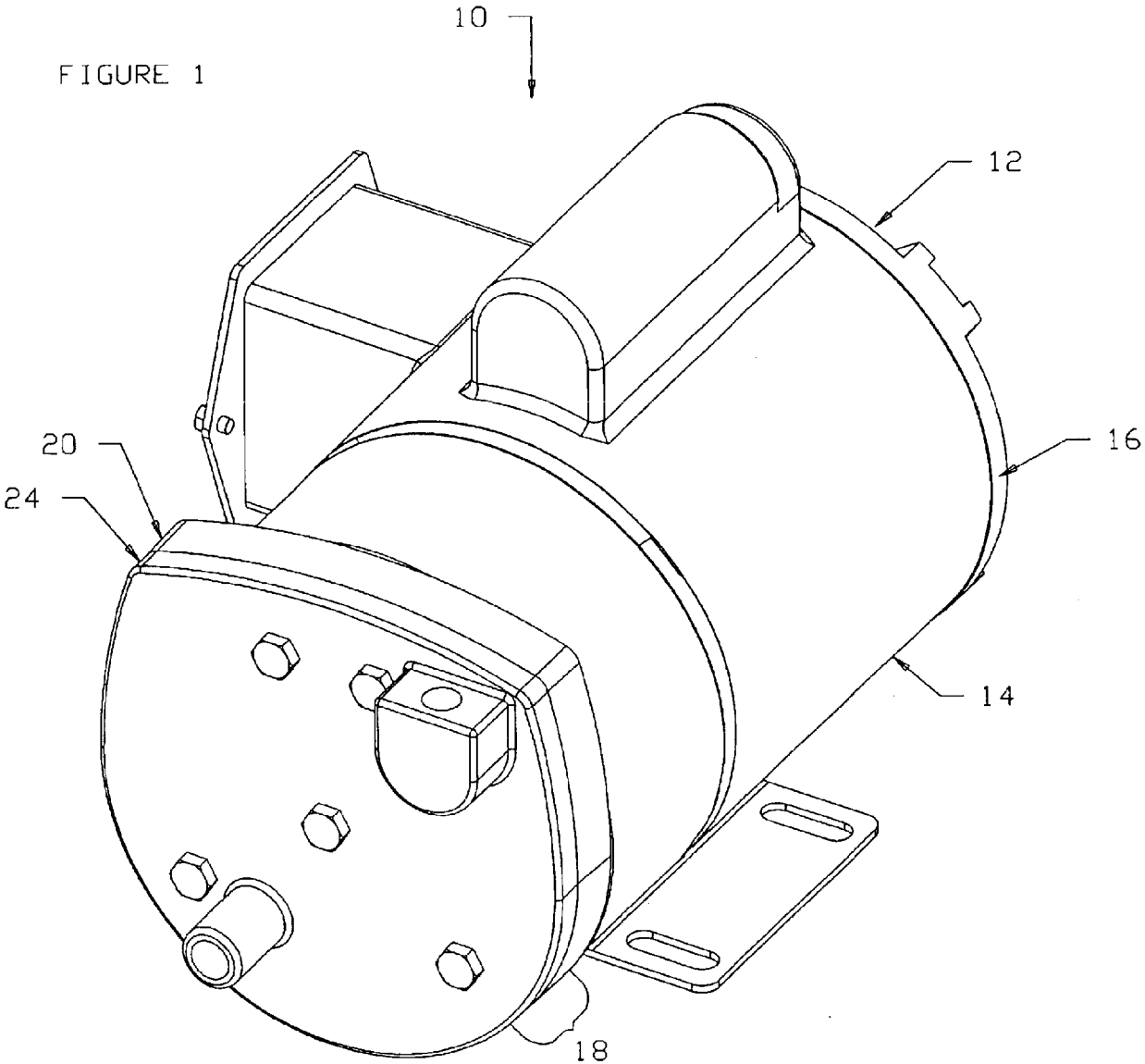
FIG. 1 is an isometric view of a rotary vane compressor with an end plate having tube-type connections.
Figure 2:
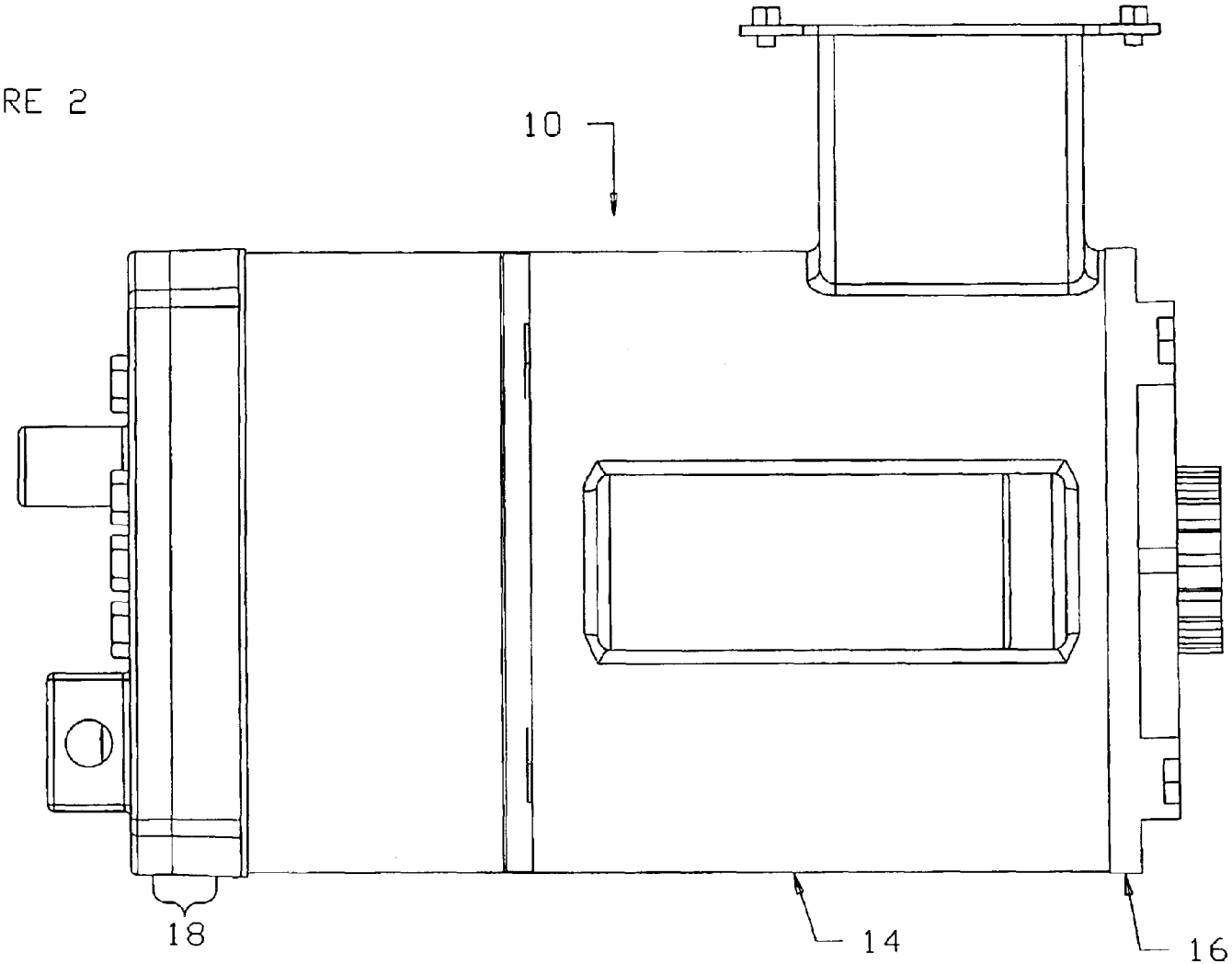
FIG. 2 is a top view of the rotary vane compressor of FIG. 1.

A rotary vane compressor 10 generally is shown in FIGS. 1 and 2. The compressor 10 includes a housing 12 having a generally cylindrical main part 14, a back end closure 16 and a front end closure assembly 18. The front end closure assembly 18 includes an intermediate plate 20 and is shown with a relatively thin end plate 24 having tube type connections at its front. The back end closure 16 and the front end closure 18 are each secured and sealed to the housing 12. A rotary vane compressor mechanism (not shown) is positioned within the housing 12. The mechanism, per se, is known in the industry and may be of the type shown in the catalog from Gast Manufacturing Inc., referred to hereinbefore.

Figure 3:
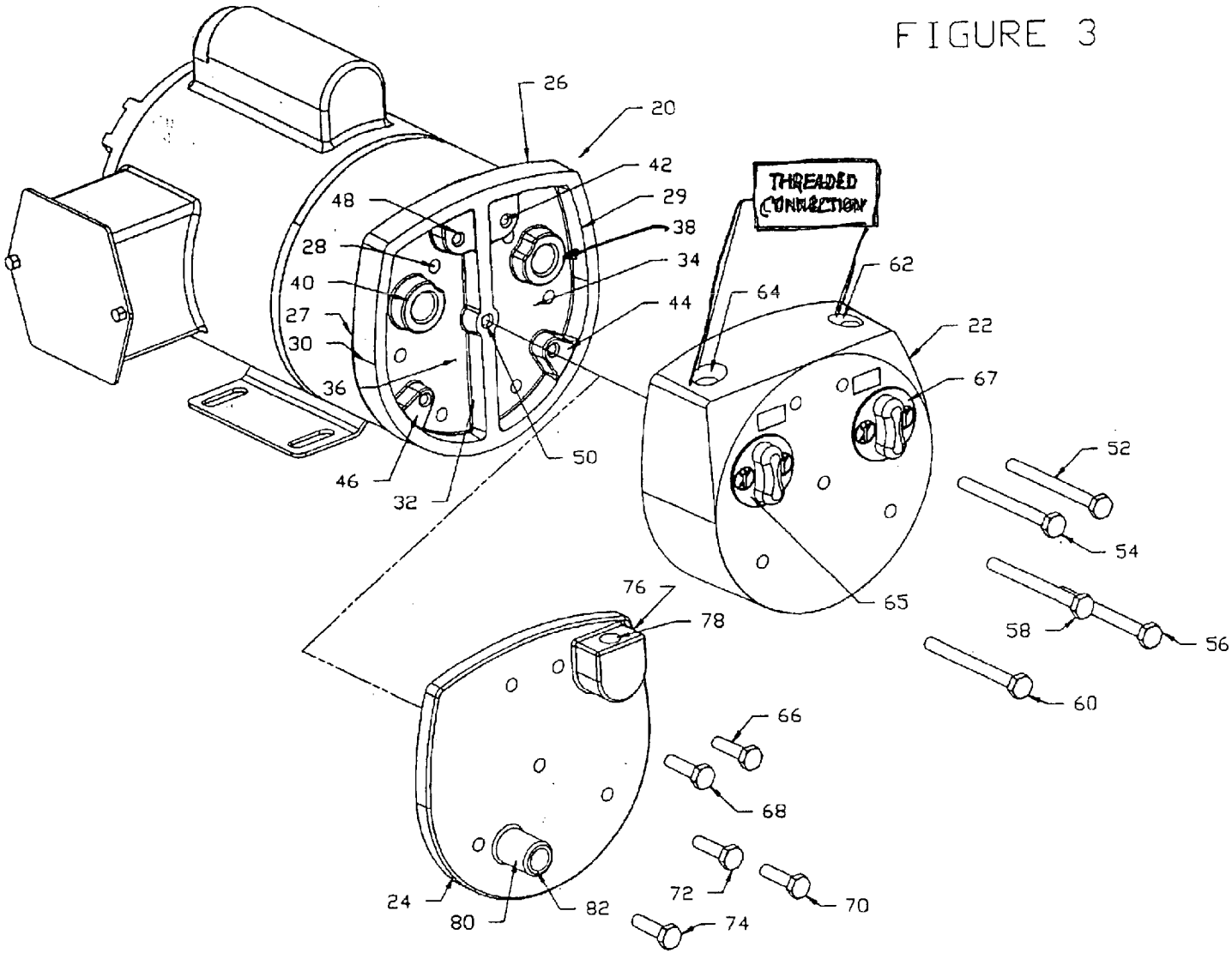
FIG. 3 is an exploded isometric style view showing the compressor housing, an intermediate adapter plate and (1) an end plate (i.e., muffler box) with threaded connections for a plumbing style connection and (2) an end plate with tube style connections.

Referring now to FIG. 3, the closure 18 includes the intermediate adapter member 20 generally and one of "muffler box" threaded type end plate 22 or the tube type end plate 24.

The intermediate adapter member or front plate 20 is a flat, recessed and plate-like member that includes a compressor side or face 26 which is defined by a rear wall 27 that is secured by bolts such as 28 to the compressor housing. The intermediate adapter member 20 also includes an end plate engaging surface such as 29. The intermediate adapter member 20 further includes a collar-like arrangement 30 about the periphery of the intermediate member. A centrally-positioned divider rib 32 is provided which is joined to the collar-like arrangement and separates the intermediate adapter member into an inlet section 34 and an outlet section 36. Within the inlet section, there is a fluid inlet opening 38 and within the outlet section there is a fluid outlet opening 40. Peripheral securement points 42, 44, 46, and 48 are provided in association with the collar-like arrangement. A central securement point 50 is provided in the divider rib. Thus, the compressor or mechanism draws air through the inlet section 34 and opening 38 and expels compressed air through the outlet section 36 and opening 40.

Either of the end plates, the threaded type end plate (i.e., muffler box 22) or the tube type end plate 24, can be secured to the intermediate adapter member 20. Relative to the threaded end plate 22, it is seen that bolts 52, 54, 56, 58 and 60 can be aligned and secured to the securement points 42, 44, 46, 48 and 50 so as to secure the threaded end plate to the intermediate adapter member 20. The end plate is relatively thick along its top and includes a threaded inlet port 62 and a threaded outlet port 64. Mufflers (i.e., sound mufflers) 65 and 67 can be employed with this style plate. When the end plate 22 is secured to the intermediate adapter member 20, the plate's inlet port 62 is in communication with the inlet section 34 and the inlet opening 38. The outlet section 36 and the outlet opening 40 are in communication with the threaded outlet port 64. Thus, air or gases can enter the compressor via the inlet port 62, section 34 and opening 38, be compressed and then expelled via opening 40, section 36 and threaded outlet port 64.

Alternatively the tube type end plate 24 can be employed and secured to the intermediate adapter member 20. The end plate 24 is secured via bolts 66, 68, 70, 72 and 74 that engage the securement points 42, 44, 46, 48 and 50. The tube type end plate 24 is a comparatively thin plate includes a boss-like construction 76 that defines a tube-type inlet port 78 and a sleeve or a hollow cylinder 80 that defines a tube-like outlet port 82. Tubes can be attached to both ports. When the end plate 24 is secured to the intermediate adapter member 20, the inlet port 78, the inlet section 34 and inlet opening 38 are in communication so as to draw air or gas into the compressor. Outlet opening 40, outlet section 36 and port 82 are in communication so as to route compressed air or gas from the compressor.

Thus, when used in an application requiring threaded connections, the "muffler box" end plate 22 is selected. However, when the rotary compressor is substituted for a double diaphragm linear compressor and tube-type connections are appropriate, then end plate 24 is selected. Thus, by selection of the appropriate end plate, the system can be adapted to either the tube type or threaded connection type.

It will be appreciated that numerous changes and modifications can be made to the embodiments disclosed herein without departing from the spirit and scope of this invention.

What is claimed is:

1. A rotary vane compressor which includes:

an elongated housing, an end member at one end of the housing which defines an inlet port and an outlet port through which fluid can flow into and out of the compressor;

an intermediate adapter member positioned between the end member and the housing and secured to the housing with the end member being secured to the intermediate adapter member; and said end member being one of a first type wherein the ports define a tube-type connection and a second type wherein the ports define a threaded type connection.

2. A compressor as in claim 1 wherein said intermediate adapter member is a recessed plate-member which includes a collar-like construction about the periphery thereof, a rear wall and a central divider rib which engages the collar-like construction at two substantially opposed positions and divides the intermediate adapter member into an inlet section and an outlet section each adapted to communicate with one of said end plate inlet or outlet port.

3. A compressor as in claim 2, wherein each of said inlet and outlet sections define either an inlet opening or an outlet opening for communication with said inlet port or outlet port.

4. A compressor as in claim 2, wherein securement elements for the end member are provided by the intermediate adapter member with at least two securement elements defined by each section and at least one securement element integral with and defined by said divider rib, whereby said end member may be securely fastened to the intermediate adapter member.

5. A compressor as in claim 4, wherein said rear wall is recessed relative to the peripheral collar like construction and divider rib.

6. A rotary vane compressor which includes:

an elongated housing, having two ends;

an end member positioned at one end of the housing which defines an inlet port and an outlet port through which fluid can flow to and from the compressor;

an intermediate adapter member positioned between the end member and the housing, secured to the housing with the end member being secured to the intermediate adapter member;

said end member being one of a first type wherein the ports define a tube-type connection and a second type wherein the ports define a threaded type connection;

wherein said intermediate adapter member; includes a collar like construction about the periphery thereof, a rear wall and a central divider rib which engages the collar-like construction at two opposed positions and separates the intermediate adapter into an inlet section having an inlet opening and an outlet section having an outlet opening, each section adapted to communicate with an end plate port;

wherein the outlet of the end member communicates with the outlet opening of the intermediate adapter member and the inlet port of the end member communicates with the inlet opening of the adapter member;

wherein securement elements for the end member are provided by the intermediate adapter member with at least two securement elements being defined by each section and at least one securement element integral with and defined by the divider rib whereby the end member is securely fastened to the intermediate member and wherein said rear wall is recessed relative to said collar-like construction and divider rib.

* * * * *